United States Patent [19]

Cionini

[11] Patent Number: 4,721,046

[45] Date of Patent: Jan. 26, 1988

[54] STRUCTURE FOR FITTING, WITH A BASE, A PLANE AND SUPPORTS FORMED BY TENSION RODS AND STRUTS

[75] Inventor: Luciano Cionini, Pisa, Italy

[73] Assignee: Lavorazione Artigiana Onice di Luciano Cionini & C.S.n.c., Italy

[21] Appl. No.: 878,040

[22] Filed: Jun. 24, 1986

[30] Foreign Application Priority Data

Jun. 28, 1985 [IT] Italy ..... 11713/85[U]

[51] Int. Cl.[4] ..... A47B 13/02

[52] U.S. Cl. ..... 108/150; 108/153; 248/163.1; 248/188.91

[58] Field of Search ..... 108/150, 153, 161; 248/440, 440.1, 188.1, 188.8, 188.91, 163.1; D6/480, 486, 485

[56] References Cited

U.S. PATENT DOCUMENTS

| | | | |
|---|---|---|---|
| D. 225,950 | 1/1973 | Kienel | D6/480 |
| D. 229,808 | 1/1974 | McDonald | D6/485 |
| D. 270,091 | 9/1983 | Tonucci | D6/480 |
| 752,243 | 2/1904 | Mock | 248/440 |
| 2,657,964 | 11/1953 | Watrous | 248/163.1 X |
| 3,229,719 | 12/1965 | Beckman et al. | 248/188.1 X |
| 3,638,585 | 2/1972 | Futrell | 108/150 X |
| 3,731,639 | 5/1973 | Schliemann et al. | 108/153 X |
| 4,191,111 | 3/1980 | Emmert | 248/440 X |
| 4,321,875 | 3/1982 | Danico | 108/150 |
| 4,354,437 | 10/1982 | Logan | 108/153 |

FOREIGN PATENT DOCUMENTS

| | | | |
|---|---|---|---|
| 1476810 | 3/1967 | France | 248/188.1 |
| 1561271 | 3/1969 | France | 108/150 |
| 438619 | 12/1967 | Switzerland | 108/153 |
| 512922 | 9/1939 | United Kingdom | 108/153 |

*Primary Examiner*—Peter A. Aschenbrenner
*Assistant Examiner*—José V. Chen
*Attorney, Agent, or Firm*—McGlew and Tuttle

[57] ABSTRACT

A structure for fittings, including a base stable because of its proper weight; a top plane superimposed to said base and connected to it; and supports engaged with and projecting towards the outside from said base, each one consisting of three stem type components working respectively as a strut and a tension rod, which converge at the outer end in order to form a supporting point for said plane.

2 Claims, 3 Drawing Figures

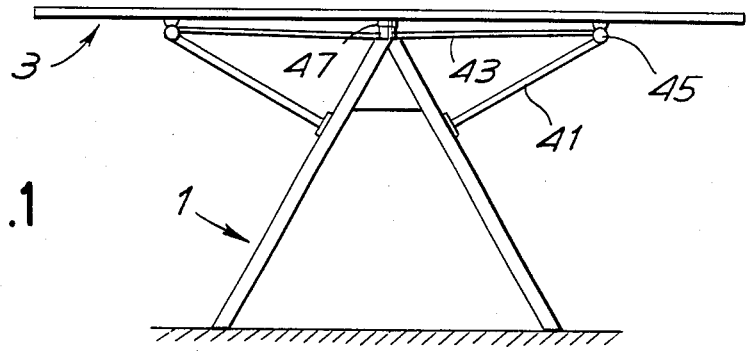
Fig.1
Fig.2
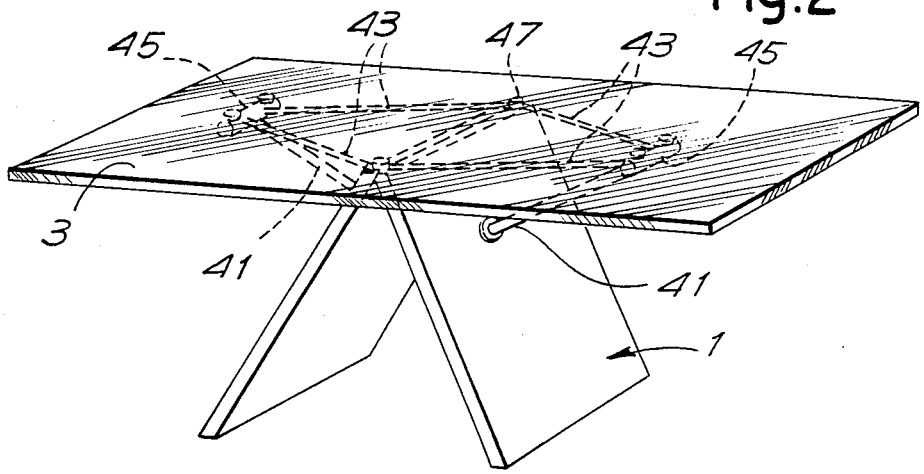
Fig.3
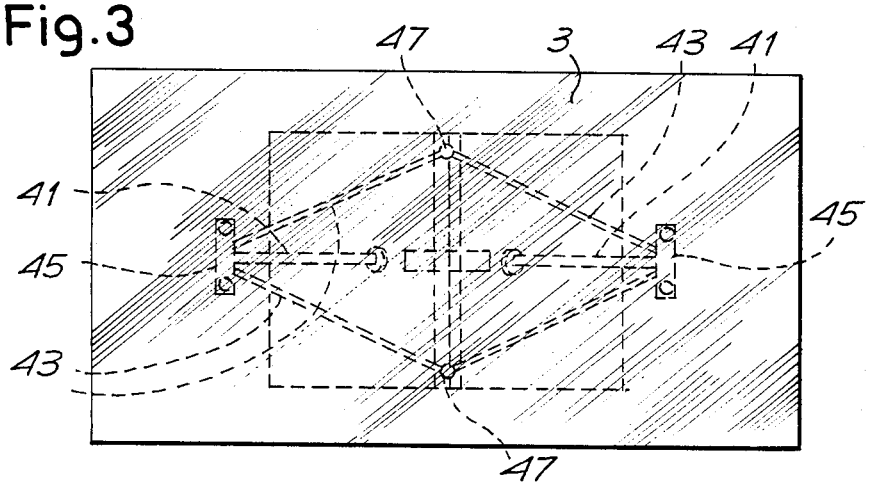

STRUCTURE FOR FITTING, WITH A BASE, A PLANE AND SUPPORTS FORMED BY TENSION RODS AND STRUTS

The object of the invention is to provide a structure for fittings, with a base and a top plane superimposed on said base and connected to it. According to the invention, to the base—which is stable because of its weight—supports projecting towards the outside are connected, each one consisting of three stem type components working respectively as a strut and as a tension rod (also flexible), which converge to form a supporting point for the plane.

This structure can include two tension rods and one strut, the latter connected to the base at a connection point lying below the connection points of the tension rods. The structure can also include two struts and one tension rod, the latter being connected to the base at a connection point overhanging the connection points of the struts.

The base may consist of stone material, especially of slabs mutually combined to form dihedrals, pyramids or other equivalent configurations.

The drawing shows a possible embodiment of the invention, and in particular:

FIG. 1 is a side view of the structure;

FIG. 2 is a perspective side view of the same structure;

FIG. 3 is a top view of a table with two supports.

According to the drawing, numeral 1 indicates a base supported upon the floor, which is sufficiently stable both because of the amplitude of the supporting polygon and because of its weight. The base—that can be realized in any suitable mostly geometric configuration—can be made of stone material and in particular—but not exclusively—of slabs of marble or other stone, mutually combined and connected in order to originate the polygon of support on the floor, with suitable development in order to reach, through a sufficient weight of the base, also the stability of the piece of furniture and in order to possibly create points for the support of plane 3. The support points may be adjustable, discrete points or may be a linear support.

To create, between the base 1 and the plane 3, a stable support according to a supporting polygon characterized by an adequate amplitude, one or more supporting means projecting from the base 1 are provided, each one including a tern of stems or stem type components working as struts and respectively as tension rods, and in particular two of them working according to the first function and the remaining one working according to the other. In the illustrated embodiment, one support includes a strut 41 and two tension rods 43 which each have ends that converge to form a point or narrow area of support 45. In the above illustrated embodiment two supports, each made of three stem type components 41, 43, 43 are provided, to create two supporting points or area 45 symmetrically spaced apart in respect to the vertex of a dihedral base 1, that in turn forms, along the corner of the dihedral, two supporting points 47 suitably adjustable in order to assure contact with the plane 3 and to develop a large supporting polygon together with the supporting points or areas 45.

Depending on the configuration of the base 1, it is also possible to obtain a number of supports working as tension rod/strut, minor or higher in comparison to what has been shown in the illustrated embodiment.

The components 41 and 43 can be made of metallic material, and shaped as rods or equivalents, being suitably engaged with the base and converging to the supporting point 45, to which they are connected.

The structure of the invention thus comprises two dihedral slabs forming a supporting base 1, said slabs having upper edges which are adjacent to each other and lower edges which are spaced away from each other, two supports each comprising three stems 41, 43, 45, with the stems of each support each having first ends that converge together at a support area 45 and opposite second ends that diverge from each other, said support areas being on opposite sides of the upper edges of the slabs and lying in a common plane, each support being connected between one of the slabs and one of the support areas 45, and a plane top 3 supported on the upper edges and on the support areas, at least one of the stems of each support comprising a lower strut 41 connected between one of the support areas 45 and one of the slabs at a location spaced downwardly from the upper edge of that slab, and at least one of the stems of each support comprising an upper tension rod 43 connected between one of the support areas 45 and one of the slabs at a connecting poing 47 at the upper edge of that slab.

Numeral 43 is used for the tension rods on both sides of the slabs and numeral 41 is used for the struts on both sides of the slabs since these structures are identical mirror images of each other.

What is claimed is:

1. A structure comprising two dihedral slabs forming a supporting base, said slabs having upper edges that are adjacent to each other and lower edges that are spaced apart from each other, two supports each comprising three stems, with the stems of each support each having first ends that converge together at a support area, and opposite second ends that diverge away from each other, said support areas being in a common plane and being positioned on opposite sides of said upper edges of said slabs, each support being connected between one of said slabs and one of said support areas, and a plane top supported on said upper edges of said slabs and on said support areas, said stems of each support comprising a lower strut connected between one slab at a location spaced downwardly from the upper edge of that slab, and one of said support areas, and said stems of each support comprising a tension rod connected between said upper edge of one slab and one of said support areas.

2. A structure comprising two dihedral slabs forming a supporting base, said slabs having upper edges that are adjacent to each other and lower edges that are spaced apart from each other, two supports each comprising three stems, with the stems of each support each having first ends that converge together at a support area, and opposite second ends that diverge away from each other, said support areas being in a common plane and being positioned on opposite sides of said upper edges of said slabs, each support being connected between one of said slabs and one of said support areas, and a plane top supported on said upper edges of said slabs and on said support areas, said stems of each support comprising a lower strut connected between one slab at a location spaced downwardly from the upper edge of that slab, and one of said support areas, said stems of each support comprising a tension rod connected between said upper edge of one slab and one of said support areas, each support including two tension rods connected between one of said support areas and one of said upper edges at spaced apart locations on said one of upper edges, said lower strut for each support being centrally connected to its slab.

* * * * *